US008185979B2

(12) United States Patent
Hentschel

(10) Patent No.: US 8,185,979 B2
(45) **Date of Patent: *May 29, 2012**

(54) COVERING FOR A PORTABLE TOILET STRUCTURE

(76) Inventor: Stephen Hentschel, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/004,118

(22) Filed: Jan. 11, 2011

(65) Prior Publication Data

US 2011/0146738 A1 Jun. 23, 2011

Related U.S. Application Data

(63) Continuation of application No. 11/739,215, filed on Apr. 24, 2007, now Pat. No. 7,877,823.

(51) Int. Cl.
*A47K 11/04* (2006.01)

(52) U.S. Cl. ..... 4/476; 4/470

(58) Field of Classification Search ..... 4/460, 611, 4/462, 476–7; 135/91, 902
See application file for complete search history.

(56) References Cited

U.S. PATENT DOCUMENTS

| | | | |
|---|---|---|---|
| 1,538,311 | A | 5/1925 | Anticknap |
| 2,886,047 | A | 5/1959 | Healy |
| 3,826,271 | A | 7/1974 | Sattler et al. |
| 5,172,711 | A | 12/1992 | Mueller et al. |
| 5,365,961 | A | 11/1994 | Bamber et al. |
| 5,430,980 | A | 7/1995 | Ferrier |
| 5,544,369 | A | 8/1996 | Roberts |
| 5,671,766 | A | 9/1997 | Williams |
| 5,678,587 | A | 10/1997 | Bilotti |
| 5,813,160 | A | 9/1998 | Thoelke |
| 5,937,452 | A | 8/1999 | Brewer |
| 6,006,809 | A | 12/1999 | Williams et al. |
| 6,148,895 | A | 11/2000 | Biggers |
| 6,182,738 | B1 | 2/2001 | Chen |
| 6,349,426 | B1 | 2/2002 | Wieringa |
| 6,615,894 | B1 | 9/2003 | McKeon |
| 6,681,413 | B2 * | 1/2004 | Weiss ..... 4/476 |
| 6,763,626 | B1 | 7/2004 | Wieringa |
| 6,837,255 | B2 | 1/2005 | Bunch et al. |
| 7,134,470 | B2 | 11/2006 | McCance |
| 7,160,612 | B2 | 1/2007 | Magill et al. |
| 7,877,823 | B2 | 2/2011 | Hentschel |
| 2002/0062852 | A1 | 5/2002 | Jopp et al. |
| 2003/0140511 | A1 | 7/2003 | Obergoenner |
| 2006/0123534 | A1 | 6/2006 | Paar |

* cited by examiner

*Primary Examiner* — Gregory Huson
*Assistant Examiner* — Karen L Younkins
(74) *Attorney, Agent, or Firm* — Sheridan Ross P.C.

(57) ABSTRACT

A method and system for providing an aesthetically pleasing covering for construction site structures, such as portable toilets and/or construction waste bins, includes expanses of material designed to encompass and/or encircle such structures. Various embodiments are directed to retractable, weather-resistant fabrics that, when employed in accordance with the present invention, create a cabana-like structure to obscure the undesired aesthetics of underlying structures. Other embodiments relate to camouflaging such structures to avoid the unpleasant visual appearance of reconstruction/remodeling projects where such structures are utilized.

18 Claims, 15 Drawing Sheets

COVERING FOR A PORTABLE TOILET STRUCTURE

RELATED APPLICATION

This application is a continuation of U.S. patent application Ser. No. 11/739,215 filed on Apr. 24, 2007. The entire disclosure of the prior application is considered to be part of the disclosure of the accompanying application and is hereby incorporated by reference.

FIELD OF THE INVENTION

The present invention is directed to a method and system for providing an aesthetically pleasing covering for particular structures typically found on a residential construction site, and in particular, is directed to enclosures for Port-O-Let toilets and construction waste bins.

BACKGROUND OF THE PRESENT INVENTION

During residential construction and/or remodeling operations, it is typical for a contractor to provide a separate standing toilet structure for use by workmen on the job site. Such structures are well known and are offered, for example, by Port-O-Let™, Gulfport, Miss. Such structures are typically constructed of a rigid and durable plastic material configured into relatively rectangular and/or cylindrical structures of over six feet in height and approximately 3 to 4 feet in length and width dimensions. The interior of such structures is typically fitted with a toilet and/or urinal, and sometimes with hand washing facilities. Such structures have been improved over the years by having odor and sanitary concerns addressed, either through venting, plumbing systems, water reservoirs, etc. Such structures, however, remain relatively unsightly in that they are typically situated in or on the periphery of residential construction sites and thus are viewable by the passing public. Because residential remodeling and/or construction projects typically take from three months to over a year, the residential community must tolerate the undesirable aesthetic aspects of such portable toilets throughout the construction operation. Adding to the undesirable nature of such portable toilets are the typical colors of materials used in the fabrication of the plastic panels or side walls of such structures. These range from blues, oranges and greens, while even the more neutral colored beige or off-white structures still present undesirable aesthetic visual components in a construction site.

In addition to portable toilets typically found on construction sites, another typical feature of construction sites consists of one or more large waste containers or tubs. Such containers are used to temporarily store demolished building materials. In many residential renovations, however, a series of waste containers/tubs may be filled up and hauled away, with new containers taking their place, as many as ten-twenty times, depending upon the volume of materials disposed of during such remodeling/construction efforts. As most homeowners who have undergone a remodeling project come to realize, neighbors often take the opportunity presented by the presence of large waste containers in the neighborhood to contribute to such waste pile with their own large refuse items, thus adding to the number of ultimate waste containers/tubs that may be required on any given work site. The waste containers/tubs are typically of a generally rectangular or trapezoidal shape and come in a variety of colors, typically green, yellow, orange, etc. Many of such waste containers/tubs are as large as a car and often larger than a truck with dimensions as large as over forty feet long and over six feet wide. Such waste containers/tubs significantly add to the unaesthetic aspects of a construction site, further diminishing the normal serene landscaped settings of most neighborhoods. Moreover, the presence of both waste containers/tubs and Port-O-Lets is a clear indication to potential thieves that homeowners may not be present in the residence, thus inviting undesired trespasses, burglaries, etc. from such work sites.

From the perspective of a municipality, the diminution in scenic beauty of a neighborhood is severely affected by the presence of the above-described waste containers/tubs and portable toilet structures. Adjacent homeowners learn to resent the remodeling efforts of neighbors due not only to the disruption of normal neighborhood peace and quiet, but also to the unsightly nature of the waste receptacles and portable toilets, often positioned near the edge of the remodeled property and near a neighbors adjacent property. Homeowners undergoing reconstruction/remodeling projects also do not appreciate the disturbing visual aspects occasioned by the necessity of having toilet facilities for workers and receptacles to store products of demolition operations. Thus, there is a long felt, but unsolved need for a method and system for providing an aesthetically desirable covering for construction site structures such as waste containers/tubs and portable toilets.

SUMMARY OF THE INVENTION

The present invention is generally directed to coverings for construction site structures, including but not limited to portable toilets and construction waste bin containers. One embodiment of the present invention is directed to an attractive covering for portable toilet structures commonly referred to as Port-O-Lets™. In view of the relatively unattractive box-like nature of existing Port-O-Let structures, one aspect of the invention is directed to providing a "cabana-like" covering for such Port-O-Lets. For example, in one embodiment, a cabana-like tent structure is provided that is specifically designed to fit around and over a Port-O-Let structure so as to give it the appearance of an attractive cabana, such as those found on beach resort properties. A separate but related aspect of the present invention relates to a covering for a utility waste bin container (or other similar storage structures) typically used during residential/commercial construction projects. Use of the term "cabana" herein should be understood to generally refer to a covering for such structures, as well as the Port-O-Let structures referred to herein. In preferred embodiments, weather and sun tolerant fabric is utilized to construct such cabanas, for example, fabric known as Sunbrella™. As one of skill in the art will appreciate, various different types of materials can be used that would be suitable for the aesthetic covering of Port-O-Let structures (and covers for construction waste containers, discussed below). While many preferred embodiments of the present invention utilize weather resistant/sun resistant fabrics, other types of materials such as plastics, rubberized canvas, Mylar, composite materials, mesh, etc. can also be utilized to accommodate particular uses, visual objectives, etc. A variety of different colors, constructions and outward appearances are made possible by the present invention, such that different themed cabana-like structures can be constructed. For example, cabana-like structures can be selected to aesthetically accompany a particular house style or neighborhood style. A Mediterranean style house could thus have a cabana-like covering for a Port-O-Let in a Mediterranean-style cabana (i.e. in terms of colors, architectural features common to a region, etc.). Various representative examples of different styles of cabana-like structures within the scope of the present invention are presented in the figures. It will be understood that references herein to a Port-O-Let structure to describe various aspects of the present invention is intended to and shall apply to types of portable toilet structures generally, and when the context permits, to other construction site structures, such as waste bin containers.

With respect to the actual construction of particular cabana-like structures included within the scope of the present invention, one of skill in the art will appreciate the numerous ways in which such coverings can be applied to existing Port-O-Let structures and/or constructed around Port-O-Let structures in order to accomplish the desired aesthetic effect. In order to affix ends of material to Port-O-Let and/or waste container-like structures, one of skill in the art will appreciate various different connection means that can be utilized including, but not limited to, the following: Velcro; snaps; buttons; adhesives; bungee cords; clips; slidably engagable portions, etc.

In other various embodiments, telescoping pole members (either lateral and/or vertical) can be provided so that different sized enclosure structures can be generated. For example, Port-O-Lets that have two or more connected structures can be covered by using a covering support structure of the present invention that permits telescoping members to be moved relative to each other to accommodate the expanse and/or height of such multiple portable toilets. In a similar regard, telescoping poles can be utilized with construction waste bins given the variety of sizes and dimensions of such bins. As one will appreciate, the use of telescoping features for roof structures also accommodates not only different sized portable toilet structures and/or construction bins, but also permits aesthetic variation of roof heights, the provision of castle-like and/or steeple-like features on or integral with such coverings, structures, etc. As one of skill in the art will appreciate, telescoping members can be locked into desired relative positions with suitable locking members, such as twisting screw locking collars, button pins that lock respective tubular members into respective desired positions and cotter-pin like structures that correspond to various apertures in hollow tubing comprising the telescoping members, etc.

The side walls of any portable toilet/container bin can be covered with one or more separate pieces of material, preferably separately forming side walls and a top-most covering for such structure. Separate support poles can be utilized to support such side expanses of fabric and for particular configurations of a top most roof portion to such a covering for such structures. For example, cabana-like structures can be created by provision of a relatively rectangular shaped, pole-supported structure having suitable longitudinal and lateral supports operatively connected to each other, with an alternative roof covering either positioned on top of such rectangular structure and/or supported by a roof apex structure formed by similar connecting poles at the apex of such structure. Additional supporting structures, such as poles, can be provided to extend a shade covering (e.g., awning, see FIG. 1) from about the upper most portion of a Port-O-Let side wall and projecting out from the structure at least several feet, thereby providing protection from sun, rain, snow, etc., and facilitating a more acceptable (e.g., drier) entrance section to a portable toilet structure. Domed and various other geometric configurations (e.g. triangular, octagonal, etc.) are also within the scope of the present invention. As used herein, "ceiling" refers to the top-most portion of a given structure and a covering for a ceiling will be understood as covering substantially the entire area of the exterior of such top most portion of a structure.

In one embodiment, retractable shade devices can be affixed to the upper regions of a Port-O-Let, thus allowing one to draw down accumulated fabric from a pull shade structure and attach the extended fabric to a lower (or opposite) portion on or next to the Port-O-Let. Each perimeter wall of a Port-O-Let can thus be provided with such a pull down (or pull up or sideways) retractable shade pull device, such that it is relatively easy to camouflage the Port-O-Let by desired pull down fabrics. Such retractable mechanisms can be retrofittable to existing Port-O-Lets by appropriate use of anchoring mechanisms on the sides, top or bottom portions of such structures. For example, simple mounting brackets can be provided on such structures to reversibly accept pull down devices having suitable lengths of fabric provided therewith. Different pre-loaded fabric pull shade devices can be selected to be either permanently and/or reversibly mounted to the appropriate sidewalls and/or roof portions of Port-O-Let structures. Indeed, in one embodiment, the transporting hook members present on many conventional Port-O-Let structures can be utilized as connection points for fabric lengths and/or panels utilized in the camouflage/covering of such Port-O-Lets in accordance with the present invention.

Another aspect of the present invention relates to the inclusion of advertising and/or identifying material on material covering a Port-O-Let outlet. With respect to this aspect, U.S. Patent Application Publication No. 2006/0123534 entitled "Advertising Method Using a Portable Toilet Unit" is incorporated herein in its entirety by this reference. Also incorporated herein by this reference are two U.S. Pat. Nos. 6,763,626 and 6,349,426, both to Wieringa. The '626 patent is entitled "Portable Toilet Advertising System" and the '426 patent is entitled "Portable Outdoor Toilet with Advertising Indicia". In accordance with the present invention, providing advertising information on replaceable fabric materials, the interchangeability and updating of such material is rendered far easier than as disclosed in prior art systems. Particularly for construction waste bins, advertising of the construction bin supplier, the contractor performing the remodeling/reconstruction work, the city in which the work is being performed, etc., can be provided on or associated with the covering of the waste bin containers (e.g., either through transparent envelope structures to accommodate such advertising and/or through actual imprinting of the material making up the covering material itself.)

One embodiment of the present invention provides for enclosures on the exterior of the fabric material encompassing a Port-O-Let and/or construction bin in order to facilitate placement of advertising materials beneath a transparent window of plastic or suitable material. Such advertising "envelopes" provide a ready way by which to change or accommodate the outward appearance of the enclosed structure of the present invention without the necessity of having different pieces of material actually provided as the main cover for the Port-O-Let and/or waste bin/tub.

One aspect of the present invention relates to camouflaging the Port-O-Let and/or waste/tub container structures using the vast variety of camouflage materials available. For example, in a residential community during the summer months, where bluegrass lawns and verdant trees are plentiful, a primarily green based camouflage material can be utilized to encircle/encompass unsightly structures, such as portable toilets and construction bins. Similarly, when construction takes place during the winter months where predominantly snow covered surfaces are present, white colored material can be utilized to camouflage such structures. Likewise, Fall colors can be used for seasonal changes to hide the undesirable aspects of portable toilets and construction bins. Indeed, the present invention also includes the ability to "decorate" a premise with holiday themes (e.g. Easter, Halloween, Christmas, etc.) such that the cabana-like structures can have appropriately themed features. The desirable interchangeability aspects of the present invention provides for the ability to modify the visual appearance of any particular covering to alternatively present a cabana-like structure at certain times of year, followed by camouflaging material at other times of year. The overall effect is that the typically unsightly Port-O-Let and construction bin receptacles of the prior art is remedied by the use of one or more aspects of the present invention.

Yet another aspect of the present invention relates to the use of aesthetically pleasing coverings for public and large private events where portable toilets are provided. For example, municipalities often celebrate festivals in various parks and the number of attendees requires the provision of numerous portable toilets. Such rows of toilet structures, whether connected or individually, present an unsightly eyesore, especially amidst the jovial and festival-like atmosphere of covered canopies and tents of food vendors, artisans, etc. Thus, one aspect of the present invention is to provide a method and system for an aesthetically pleasing covering for such portable toilet structures so as to blend in with the festival-like settings of such occasions. In one embodiment, coverings encompass more than one portable toilet structure. For example, covering material of the present invention would span at least two side walls of two separate structures, and such covering may depict more than one scene in such an extended fashion. Covering material may span 2, 3, 4 or more portable toilet sidewalls, when placed adjacent to each other and the covering material may be connected to each individual structure at least at one point on the exterior thereof. Alternatively, covering material spans a plurality of structures along any given direction, but is supported at each end by being connected to (or adjacent to) end-most toilet structures. Similarly, large private parties often require the provision of portable toilets to accommodate a large number of guests. Portable toilet structures, as they presently exist, are less than desirable from an aesthetic perspective and the present invention provides a method and system for enhancing the visual aspects of such structures to either blend in with the surroundings to which the structure is positioned and/or to be viewed as a higher-end tent or cabana.

Yet another aspect of the present invention relates to the provision of insulating material to cover Port-O-Let structures. In conventional portable toilet structures, little if any insulation is provided. The present invention provides for at least one insulative area created by material extending from or surrounding the Port-O-Let structure on its sides and/or top most portion. Thermally enhanced material, such as that available from Outlast Fibers, Boulder, Colo., can be utilized to provide a thin yet insulating barrier, thus providing a more desirable interior temperature for an occupant of a portable toilet, whether in hot or cold environments. Other insulative materials may also be used, including thicker, quilted and/or air-entrapping expanses of material with insulating capabilities. The air-zone created between the exterior wall of a Port-O-Let and a covering acts as a temperature regulation area, providing desired insulative properties, such as a zone preferably being less than 5 inches, more preferably less than 3 inches and most preferably less than about 1.5 inches.

It is envisioned that municipalities may soon legislate certain rules and regulations with respect to the appearance of Port-O-Lets and/or waste bins used during remodeling/construction projects. Municipalities may provide structures as set forth in the present invention on a rental basis, which would not only increase potential revenues to such municipalities, but would also ensure a uniformity of appearance to any given construction site within such municipality. In such a manner, the municipality may police its aesthetic character in ways similar to the rules and regulations passed with respect to covenants as to paint colors, height, size and presentation provisions of any structures within such municipality. Portable toilet structure providers may also offer kits and/or may outfit structures with the coverings of the present invention prior to or along with transport thereof. Such rental programs are considered as encompassed by the present invention.

Still other embodiments of the present invention include provision of lighting for such structures, either as a decorative element to lend to the desirable appearance of such structures and/or to illuminate the interior or exterior of such structures for users thereof. In one embodiment, lighting (preferably solar powered lights) is provided so that the structures are appropriately illuminated in the darkness, with different colored lenses for such lighting provided to enable various different aesthetic appearances of cabana-like structures at night. For example, male bathroom cabana-like structures can be illuminated in blue, whereas female cabana-like structures can be illuminated in pink, thereby directing guests at a party to the appropriate structure based on such lighting color alone. Obviously, the particular color of fabric used for cabana-like structures of the present invention can also be appropriately marked, illustrated and/or colored to direct suitable audiences, whether it be gender-based, child versus adult, etc. Reflective material may be operatively associated with the exterior of the exterior covering for a portable toilet structure and/or waste bin container in order that such structures can be more visible under illumination.

In still other embodiments of the present invention, heating and/or cooling units are provided in operable association with the cabana-like structures of the present invention so as to create a more comfortable environment for use by patrons. For example, an electric and/or solar powered fan can be operatively associated with the upper-most and/or side portions of a cabana-like structure in order to circulate air in a desired fashion to either: 1) avoid any undesired trapping of heat within the cabana structure itself; or 2) create an insulative effect for a desired temperature effect. Still other embodiments employ spray mist systems used in association with the coverings for the portable toilet encompassing system, in order to provide a cooler environment in or surrounding the Port-O-Let structure.

To accommodate environmental conditions, such as wind, the cabana-like structures of the present invention can be tailored so as to provide for the passage of wind through the covering material structure without degradation or destruction of the covering structure. For example, providing baffles, vents, closeable flaps, etc., within certain stretches of fabric, whether they be on the side walls of the Port-O-Let coverings and/or the top-most portion thereof, enables wind to pass through and/or around such structures without causing undesired ballooning or damage of the covering structure itself.

With respect to waste receptacles/containers/tubs, and as presented with respect to portable toilet structures, various methods of providing an aesthetically pleasing covering for such structures will be apparent to one of ordinary skill in the art given the guidance and direction as provided by the present application. For example, the provision of a circular, triangular, square or polygonal rod that can accumulate material while being rotated around its axis provides a "draw shade" type mechanism to facilitate the reversible presentation of lengths of the material in order to cover and/or camouflage waste bins/tub structures. Such retractable fabric/plastic systems can be operatively associated (e.g. using brackets, magnets, slidably mating structures, hook, loop connectors, etc.) with the exterior sidewalls of waste containers. As set forth herein, advertising or other identifying material can be provided on such material lengths, or alternatively, camouflage or more fanciful artwork, scenes, illustrations, images, artwork, etc. can be presented.

In embodiments where the coverings of the present invention are used with construction waste bins, fanciful top-most coverings can be provided that not only provide the desired aesthetic appearance of a covering, but also serve to preclude access to the waste bin materials by animals, such as birds, etc. In such embodiments, there may be provision of large ingress and egress holes, either in one or more of the side walls and/or in the ceiling structures of such coverings in order to facilitate continued use by demolition workers depositing material into such structures during their demolition operations.

A still further aspect of the present invention relates to the retrofittability of existing Port-O-Let and/or waste container structures with components so as to affect an aesthetic covering being relatively easily and readily associated with such structures. For example, mounting structures for support pole members can be retrofittably attached to a Port-O-Let, thus enabling a user to alternatively decide whether to maintain the Port-O-Let in its "native" state, or to otherwise associate coverings to the exterior of the Port-O-Let and/or waste container structures. In one embodiment, mounting brackets can be associated with the appropriate sides, top and/or bottom to connect pole members, with such pole members then being associated with fabric coverings of appropriate and desired colors, designs, lengths, widths, etc. One of skill in the art will appreciate the variety of pole and/or other connection devices common in the tent industry to satisfy the vast variety of designs that can be employed.

Alternatively, instead of associating pole members with connecting structures on the exterior of Port-O-Let or waste containers, connecting points can be established directly on the exterior of Port-O-Let and/or waste container structures so as to facilitate direct connection of coverings at such points, thus permitting the expansive covering of a Port-O-Let by merely associating a covering directly with connection points on the Port-O-Let structure itself. Such connection points, as one of skill in the art will understand, can be of various shapes, configurations and constructions, but include, without limitation, hooks, snaps, button-like features, hook and loop (Velcro™) complimentary structures, mating units, slidably or hingedly engagable portions, magnets, etc.

When pole members are associated with the exterior of such structures, such pole members can be snapped into complimentary mounting brackets that have similar surfaces and/or circumferences that are adapted to receive a pole member in a releasably fixed orientation, thus supporting an expanse of a covering along the extent of the pole member. Panels can be used to connect directly to exterior walls of portable toilet structures and/or waste bins using suitable connection means as set forth herein. Similar to the discussion above, roof covering material structures can be established on the tops of Port-O-Let structures and/or waste container structures by providing retrofittable attachment points and/or features on the tops and/or near the top-most portions of such structures. As described above, various connection means can be utilized to achieve the desired attachment of fabrics, panels and/or pole members and/or any other type of supporting structures desired to achieve the top-most canopy, cabana-like, etc. effects in accordance with the present invention.

One aspect of the present invention is directed to a system for providing an aesthetically desired exterior for a portable toilet structure, such system including a covering material that substantially covers the sides of a portable toilet structure with the covering materials selecting from the group consisting of fabric and plastic and being distinct from and thinner than the exterior material making up the side walls of the portable toilet. A means for securing the covering material around the portable toilet structure can be used to substantially surround the sidewalls of the toilet structure in order to obscure a viewing of such sidewalls by a person located outside of the portable toilet structure. In some embodiments, an additional ceiling covering material adapted to substantially cover the top most portion of the portable toilet is provided. In one embodiment, the means for securing the covering material around the portable toilet structure comprises tubular perimeter frame poles that can be either self supporting or supported by certain connections with the portable toilet structure itself. In other embodiments, a temperature regulating element, such as an air conditioner, fan or heater, can be provided to operatively associate with the covering materials in order to ensure positive pressure inside the enclosure, evacuating unpleasant odors from the interior structure, etc.

In certain embodiments, frame poles can be attached to the portable toilet structure using hook and loop fastener elements oppositely opposed to each other and provided on the covering material and the portable toilet structure itself and/or frame poles, in order to secure the covering material about the portable toilet structure. In other embodiments, panel assemblies can be utilized that are sized so that they extend between bracket assemblies located on each of the sidewalls such that at least three walls are substantially covered by the panel assemblies. In still other embodiments, an expansive material comprising the covering material is mounted to a reversibly rotatable element that permits the material to be drawn out in an extended fashion and that can wind such material onto the element (e.g. automatically) and retract the material when desired. Still other embodiments rely upon existing structural features of the portable toilet or waste bin container to provide connection points. For example, magnetic connectors can be associated with covering material so that coverings can be "hung" or "stretched" by merely positioning the magnets over metal material contact points existing on the portable toilet/waste bin. Such magnet attaching metal features may already exist on such structures or may be added thereto to facilitate the provision of a covering. Moreover, certain embodiments have slidable extensions that slidably mate with one or more existing (or added) features of a portable toilet/waste bin structure. These slidably engagable coverings, panels, etc. can be readily removed for easy cleaning (e.g., via a hose or by laundering, as through a car wash).

Yet another embodiment of the present invention is directed to a kit for providing a cover for a construction site structure, such as a portable toilet having at least four walls and a ceiling. A plurality of brackets mountable to an exterior of a portable toilet structure is provided along with an expanse of covering material having connection points, each of which are connectable to at least one of the brackets. The covering material is sufficient, when extended and positioned around the portable toilet structure, to substantially cover at least three of the four walls of the portable toilet structure. An alternative top cover connectable to at least one of: the plurality of brackets; the covering material; and/or an exterior portion of the ceiling of the portable toilet; may also comprise the kit.

Other embodiments of the present invention are provided with lighting elements to illuminate the structure with a desired color of light, single colors of light selected from the group consisting of blue, pink, green, purple, orange, yellow and red. In particular, the color of the fabric itself can be provided to indicate, for example, male and female restroom structures or, alternatively, specifically colored lights can be shown upon a more neutral colored covering material in order to provide appropriate colored denotation of a particular structure. Such illumination systems can be used, for example, to celebrate particular holidays that have particular colors associated with them (i.e., green and red for Christmas, pink for breast cancer events, etc.)

In still other embodiments, the covering material can be zippered together to form integral and expansive covering materials of various dimensions, colors, fabrics, etc. It can also be provided with zippers or other closure means such that when the covering material is folded properly, it can be formed into an integral carrying container, zipped or otherwise reversibly connected door coverings may also be provided.

Particular embodiments of the present invention include reflective materials associated with the covering material itself in order to provide reflectiveness at night when illuminated by headlights, outdoor lighting, etc. Preferably, the covering material is breathable and comprises a mesh material to allow for fluid communication of air there through. In other embodiments, ballast securing mechanisms can be provided to add additional weight to afford greater stability for the units when constructed, thereby facilitating use of such structures in windy environments. Ballast can be included along the bottom-most edge of a covering adapted to expand over at least one side wall of a structure.

A particular aspect of the present invention is directed to a system for retrofitting existing portable toilet structures to enhance the outward appearance thereof In such embodiments, a plurality of covering attachment mechanisms connectable to the exterior of the portable toilet are utilized, with such attachment mechanisms positioned on at least three walls of the portable toilet. One or more expanses of material sized to cover substantially all of the exterior of the portable toilet is provided. Moreover, a plurality of securing devices operatively associated with one or more portions of the covering material is provided, with such securing devices adapted to connect to the covering attachment mechanisms in a manner such that when connected, the expanses of covering material are positioned about the portable toilet to substantially obscure the exterior thereof Preferably, the material used to cover the portable toilet comprises a thin, weather resistant fabric. Certain embodiments employ a quilted or insulative material in order to provide a warmer environment for users of such portable toilets. The temperature inside such units can be further adjustable by use of fans, heaters, etc., or can be adjusted by relying upon solar energy, including the provision of dark or black colored panels or roof-most portions of the covering materials in order to absorb solar radiation. Such solar energy (e.g., through the use of photovoltaic cells) can be used to power fans to circulate air within or about the portable toilet structure enclosures. Solar energy can also be relied upon to power solar lights such that during evening and nighttime activities, such structures are at least partially illuminated by provision of such solar powered lights operatively associated with the cabana-like structures of the present invention.

Certain embodiments of the present invention do not include a top-most covering for a portable toilet and/or for a waste bin container. Instead, the side panels are constructed to be at a height to obscure normal (e.g., ground level) viewing of the top most portions of the portable toilets and/or waste bin containers, thus eliminating any need for a top most covering, making such obscuring structures more economical, easier to construct and reversibly assemblable etc. In certain embodiments of the invention, magnetic means can be used to reversibly attach expanses of fabric, plastic, panels, etc. to the outermost portions of either a Port-O-Let structure and/or a waste bin container. Especially in the latter case, waste bin containers are typically constructed of steel and magnetic means are very suitable for employment in connecting panels, expansive materials, etc. to the outermost portions of the waste bin containers, thus obscuring their undesirable visual aspects. Such magnetic connection features can be used alone or in combination with other connection means, e.g. along with leg supports, etc. As one of skill in the art will appreciate, magnetic means can be used in connecting covering materials directly to the exterior of structures in any number of the various embodiments of the present invention, or alternatively can be used to connect such materials directly to supporting poles used with such structures, thus providing the desired obscuring attributes of the screens, panels, expansive materials, etc., all in accordance with the present invention.

In many embodiments, the desire will be to have the Port-O-Let structure and/or the waste bin container essentially "blend in" with the surrounding environment. As such, providing a façade of brick, stones, fences, shrubbery, flowers, etc. on the panels, expansive materials, etc. is within such preferred embodiment. Appliqués of any type can be reversibly attached to covering material to facilitate varied scenes, provide advertising, etc. In other embodiments, attention to such structures is desirable so that individuals can locate the Port-O-Let structure in particular environments, such as a festival, trade show, etc. In such embodiments, one embodiment of the present invention provides for a pinwheel type structure associated with the covering for such Port-O-Let, with such pinwheel being capable of rotating, thus attracting attention to the site of the Port-O-Let structure. In such a way, individuals can locate the Port-O-Let structure based on a fanciful and preferably moving device, rather than merely looking for the typical unattractive appearance of a Port-O-Let structure as presently available. Wind vanes, advertising banners, etc. can supplant and/or accompany such pinwheel like structures, which are preferably movable in accordance with wind conditions, solar energy, etc.

In certain embodiments, one or more retractable shades can be employed in association with the coverings for the Port-O-Let structures in order to adjust for different environmental conditions, or to provide a variety of desired outward appearances for the Port-O-Let structure, etc. For example, a choice of different retractable shades can be provided on at least one side of a Port-O-Let structure, connected with suitable mounting brackets, in order that one can readily and easily change the outward appearance of the Port-O-Let structure by merely retracting a desired shade type, color, advertisement, etc. Appropriate ventilation holes and/or wind apertures can be provided in any of the above-referenced covering structures for a Port-O-Let and/or for a waste bin container in order to provide structural integrity of such systems in windy environments. Provision of certain phase-change fabric material, such as that available from Outlast, Inc., in Boulder, Colo., may be utilized to effectuate desired thermal barriers for either hot or cold environments where portable toilet enclosures may be used. In this regard, U.S. Pat. No. 7,160,612 is incorporated in its entirety herein by this reference.

One particularly desirable aspect of certain embodiments of the present invention relates to the capability of moving a Port-O-Let structure and/or waste bin structure with the obscuring covering material (whether it be panels, expansive materials operatively associated with the exterior of such structures, etc.) movable along with the structure (e.g. already in place). This facilitates the storing and transporting of such covered structures and eliminates the need to constantly assemble and disassemble covering structures each and every time Port-O-Lets and/or waste bin containers are moved. As one may appreciate, given the size of most waste bin containers, it may be desirable to assemble and disassemble obscuring panels, expansive materials, etc. (as described herein) each time the waste bin container is moved and/or replaced. With respect to a portable toilet, however, the ability to have attractive facades, structurally obscuring panels or other expansive materials, operatively associated with such structures during their principal use, as well as in their storage and/or transport, provides a desirable aspect of the present invention to providers of portable toilets, such as Port-O-Let, Inc.

As depicted and discussed herein, in certain embodiments, the panels, expansive materials, etc., as disclosed pursuant to the present invention, can be attachable to existing Port-O-Let and/or waste bin container structures using existing connection points already present on prior art Port-O-Lets and waste bin containers. For example, waste bin containers often have metal hooks associated with the sides thereof, which can be employed as connection points for the covering materials of the present invention. Similarly, Port-O-Let structures typically have various corners, supporting columns, creases, indentations, metal surfaces (that can attract a magnet) that can be employed in various embodiments of the present invention in order to provide support for covering materials to connect therewith.

Still other embodiments of the present invention include separate panels being associable with one or more of the sides of a Port-O-Let and/or waste bin container structure. Such separate panels can depict similar or distinct visual representations, such as one panel depicting a flower garden whereas another panel may depict a rock face. Other embodiments of the present invention include panels that have movable structures related thereto, such as Venetian blinds and other ventilation apertures that can be reversibly adjustable in order to depict various scenes and/or to provide for adjustments to environmental conditions (e.g., ventilation, access to light, etc.). Provision of attachable structures to the covering is also within the scope of the present invention. For example, first aid kits can be operatively associated (e.g., snapped onto, buttoned to, hung from, etc.) the covering structures of the present invention, thereby providing additional functional attributes of such structure, e.g., providing a restroom facility with additional functional attributes.

The present invention includes a method for providing coverings for portable toilet structures and/or waste bin containers. Such method includes the provision of at least one embodiment of the above-described system or kit, attachment of coverings to the exterior walls of a portable toilet structure and/or waste bin container and, when desirable, further providing one or more of the following: heating or cooling elements; lighting; fans; wind-movable identifying features, and canopy supporting structures.

These and other advantages will be apparent from the disclosure of the invention(s) contained herein. The above-described embodiments and configurations are neither complete nor exhaustive. As will be appreciated, other embodiments of the invention are possible using, alone or in combination, one or more of the features set forth above or described in detail below.

DETAILED DESCRIPTION

Figure 1:
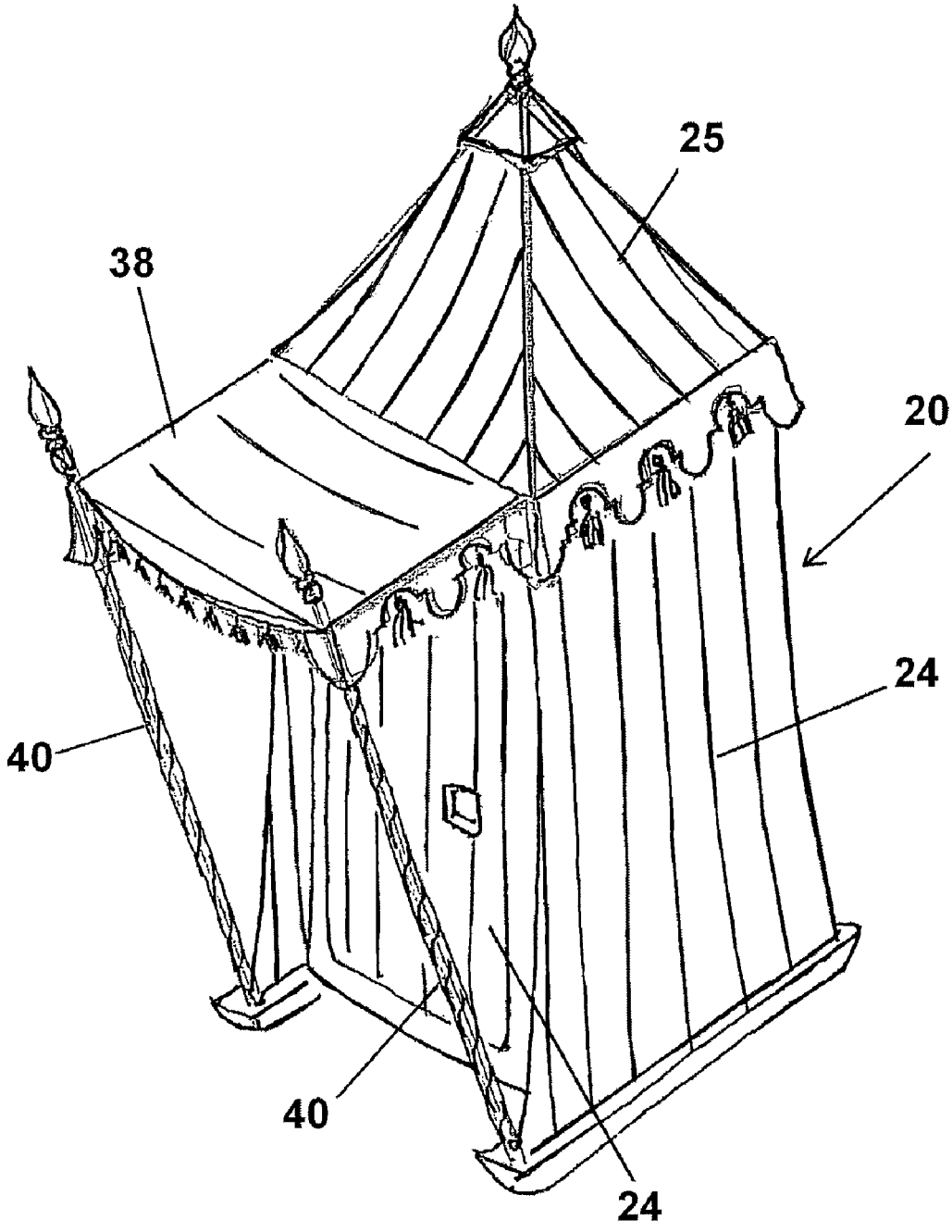
FIG. 1 is a perspective view of one embodiment of the present invention.
Figure 2:
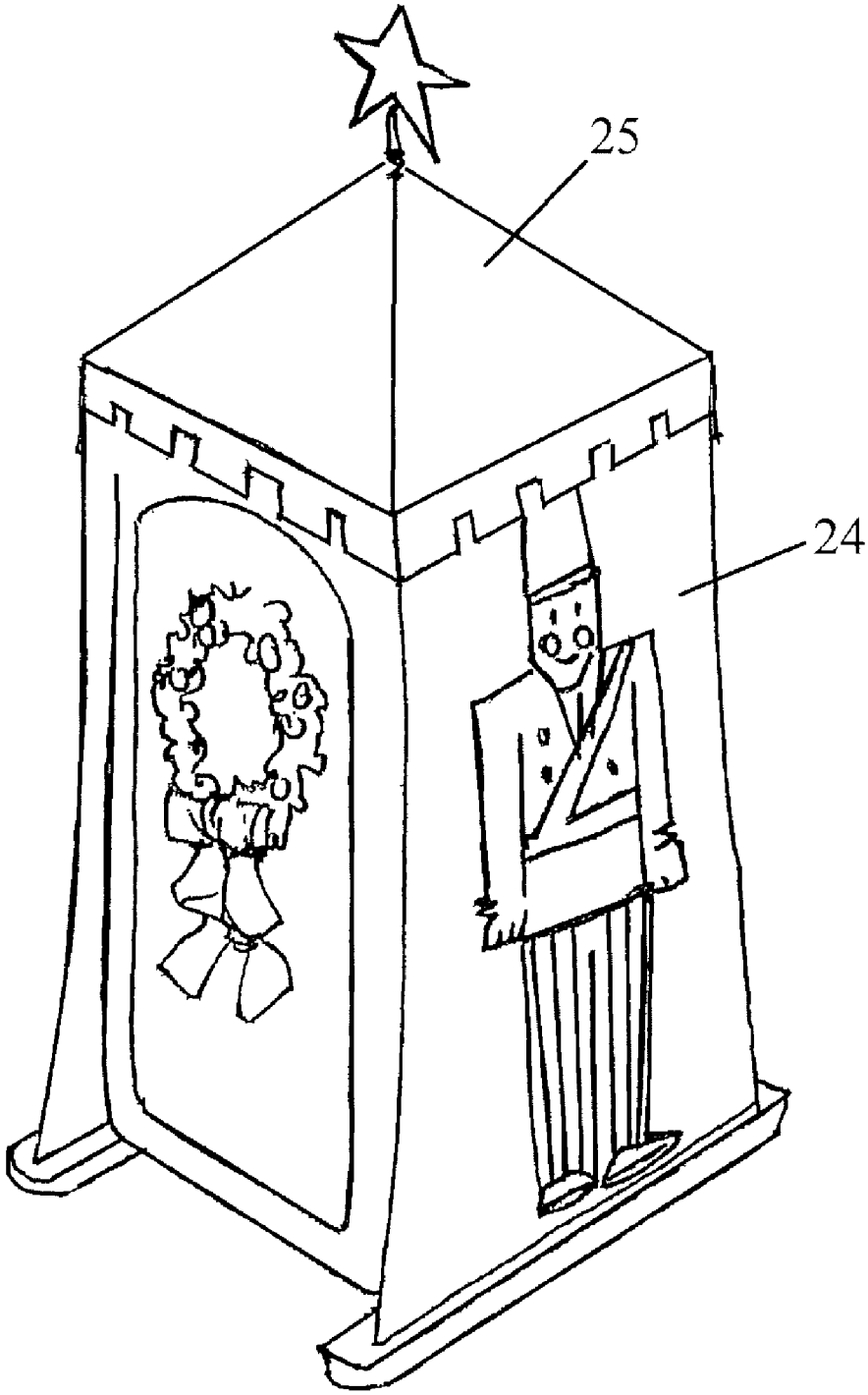
FIG. 2 is a perspective view of one embodiment of the present invention, depicting a covering with decorative features.
Figure 3:
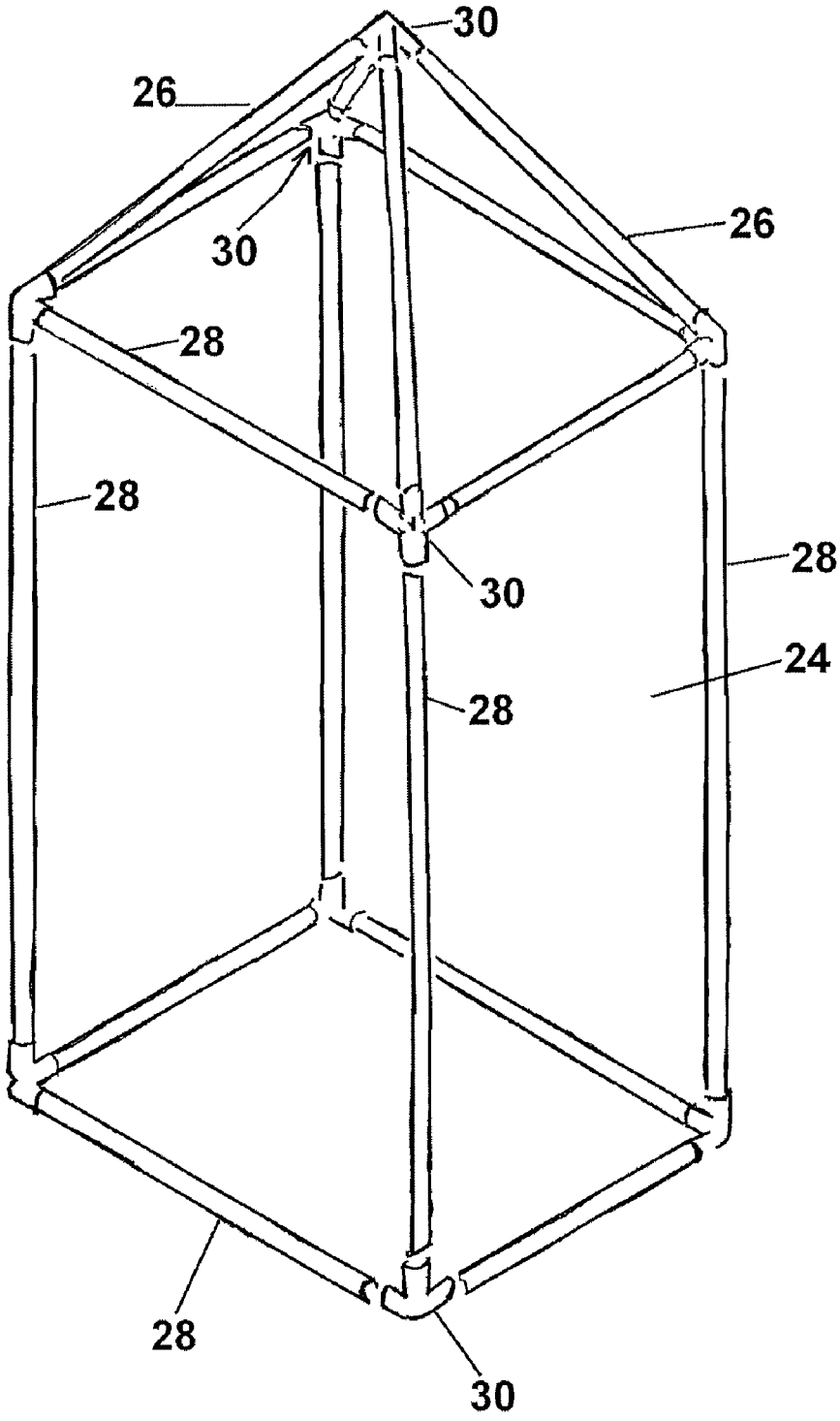
FIG. 3 depicts one means by which coverings can be associated with structures as identified in FIGS. 1 and 2, by use of pole supporting structures.
Figure 4:
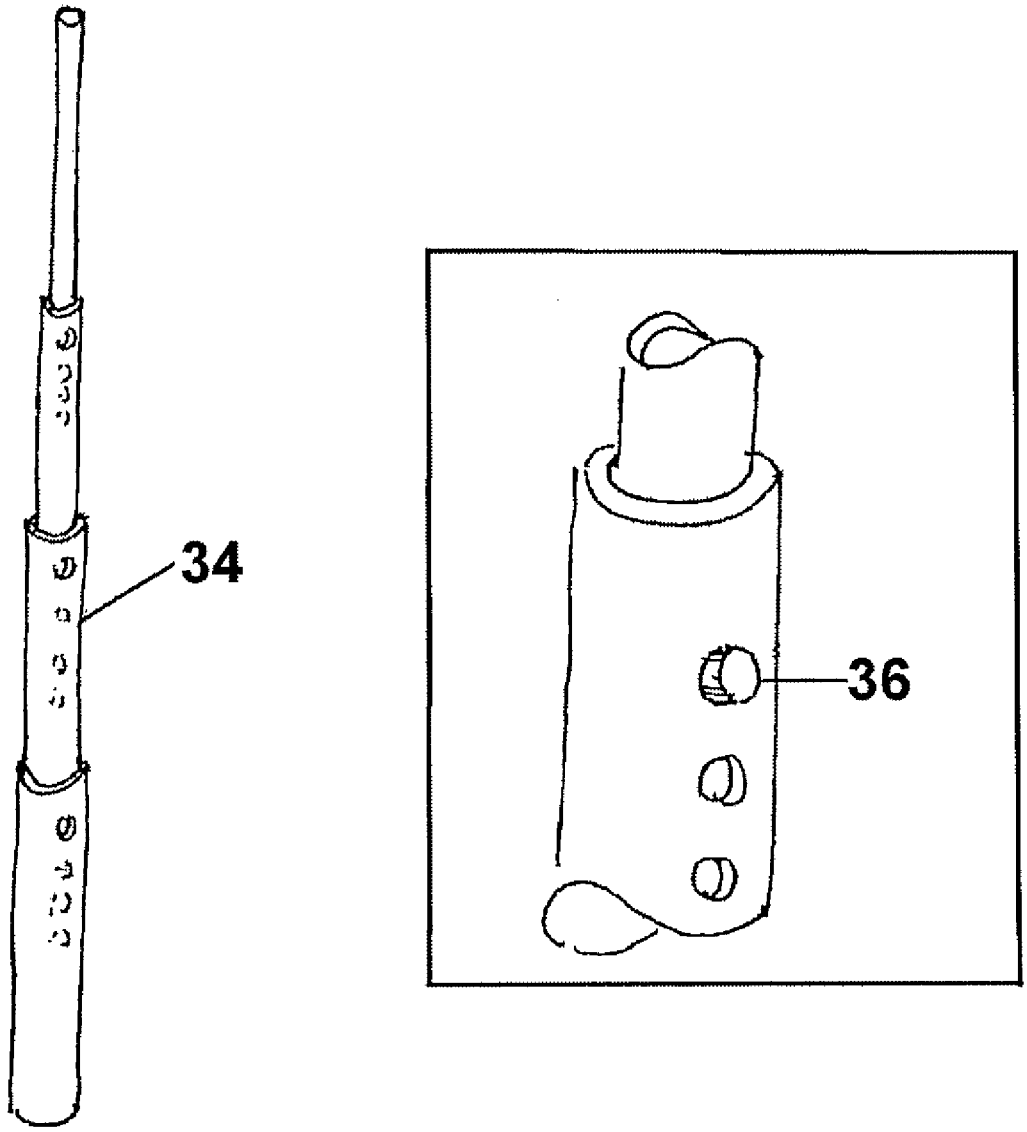
FIG. 4 depicts an embodiment where telescoping pole members are utilized to accommodate transport, adjustment of sizes, etc.
Figure 5:
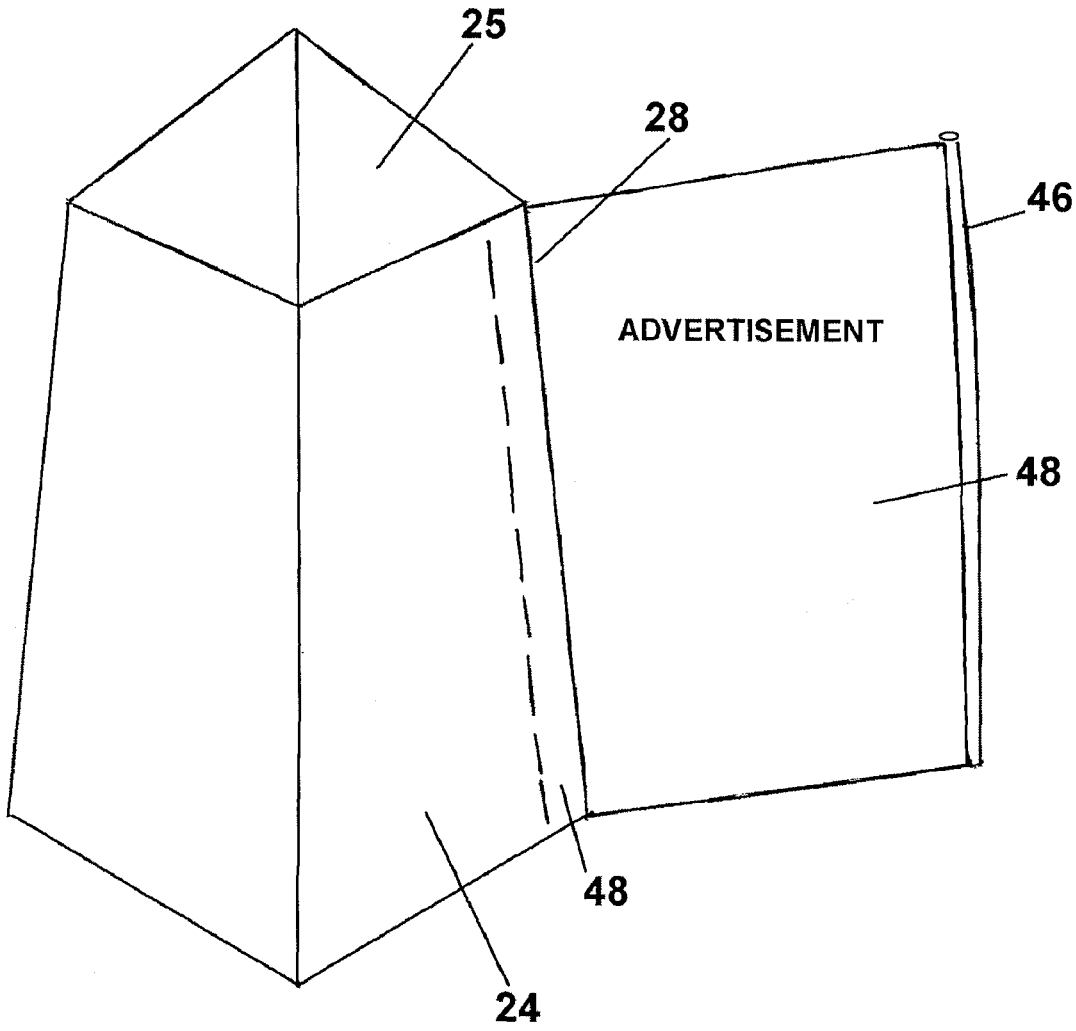
FIG. 5 depicts an embodiment where advertising material is displayed.

In one preferred embodiment of the present invention, a cabana-like structure 20 is provided that encircles and effectively covers a Port-O-Let structure 22. Such a cabana-like structure 20 can be of any geometric shape, including circular, oval, rectangular, octagonal, etc. The sides 24A of such a cabana structure 20 preferably interconnect with adjacent sides 24B so as to form a substantially rigid structure capable of withstanding wind forces, etc. In certain embodiments, the cabana structure 20 does not contain a bottom, such that it can be fitted to and/or around a Port-O-Let structure 22. The top 25 of the cabana-like structure 25 can be pitched in various ways, with one preferred embodiment being a structure composed of four roof support members 26 joined at an apex. Various structural supports 28 can be utilized for forming the side panels 24 of the cabana 20 as well as the roof and lower support structures 26. Such poles 28 are preferably lightweight and strong, more preferably made from either aluminum, composite material or plastic, and preferably consisting of hollow poles. The pole members 28 themselves can be interconnected in various ways, with corner units of the cabana structure 20, formed from suitable multiple pole retaining corners 30. For example, in a particular corner of the cabana structure 20 on the top most portion 25 of a side 24, and bottom most portion of a roof member 26, a connecting angle piece 30 is provided that accepts separate pole members.

The support/pole members 28, 26 themselves can be interconnected with each other through various means, such as by an elastic cord 32 running through the center of such pole members, much like poles used for tent construction.

Still other embodiments include pole members 26, 28 that are attachable to each other through telescoping overlapping members 24, with one member preferably having at least one aperture that can receive a corresponding retractable pin 36 on the other structure. It will be understood that various pole members 28 can be of a telescoping 34 construction so as to facilitate various heights of particular structures and/or to facilitate various roof and/or side configurations in terms of height, pitch, etc. Moreover, in separate embodiments of the present invention, an awning 38 extending away from the cabana-like structure 20 can be provided with awning support poles 40 provided to elevate the awning structure 38 above the ground and roughly in line with the lower most roof elevation. (FIG. 1)

Although separate stakes 42 connected to extending ropes or guide wires (not shown) can be utilized with any cabana-like structure 20 as described herein, in a preferred embodiment, no auxiliary support lines are deemed necessary.

To facilitate provision of an information banner 44, whether it be an advertisement, a sign displaying "restroom" "gentlemen", "ladies", etc., one or more of the supporting pole structures 28 can be fashioned so as to receive yet an additional pole 46 that is interconnected to a banner 48 containing such information.

In preferred embodiments, the pole members 28, 26 utilized with a cabana-like structure 20 fit within sleeves 50 that are fashioned in the side materials 24 of the cabana 20. Alternatively, various types of loops or tie on strips of material, clips, Velcro retaining enclosures, etc. can be utilized to ensure that the supporting pole structures 28 are in proper alignment and orientation to provide desired support for such structures.

Although various materials can be utilized to fashion a cabana-like structure 20, preferably a weather resistant, sun resistant fabric, such as the fabric material made by Sunbrella™. Alternatively, plasticized material can be utilized that repels water, reflective materials may be used/applied for night safety purposes, etc. Still other embodiments incorporate pull-down retractable mechanisms 27 (see FIG. 11) to reversibly present the sides 24 of the cabana 20 when desired. Such retractable mechanisms 27 can also be used to form the top 25 of the cabana 20. The Port-O-Let 22 can be provided (or retro-fitted) with mounting brackets (not shown) to accommodate the provision of the pull down mechanisms 27.

Figure 15:
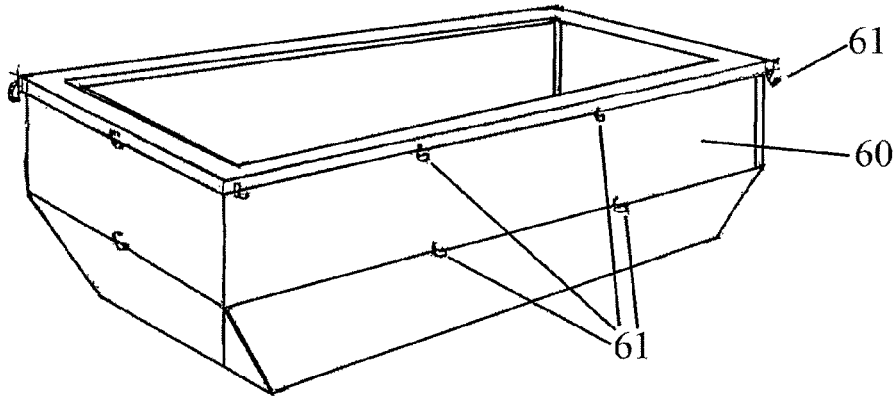
FIG. 15 depicts connection points on a waste bin container suitable for connecting covering materials and systems of the present invention.
Figure 16:
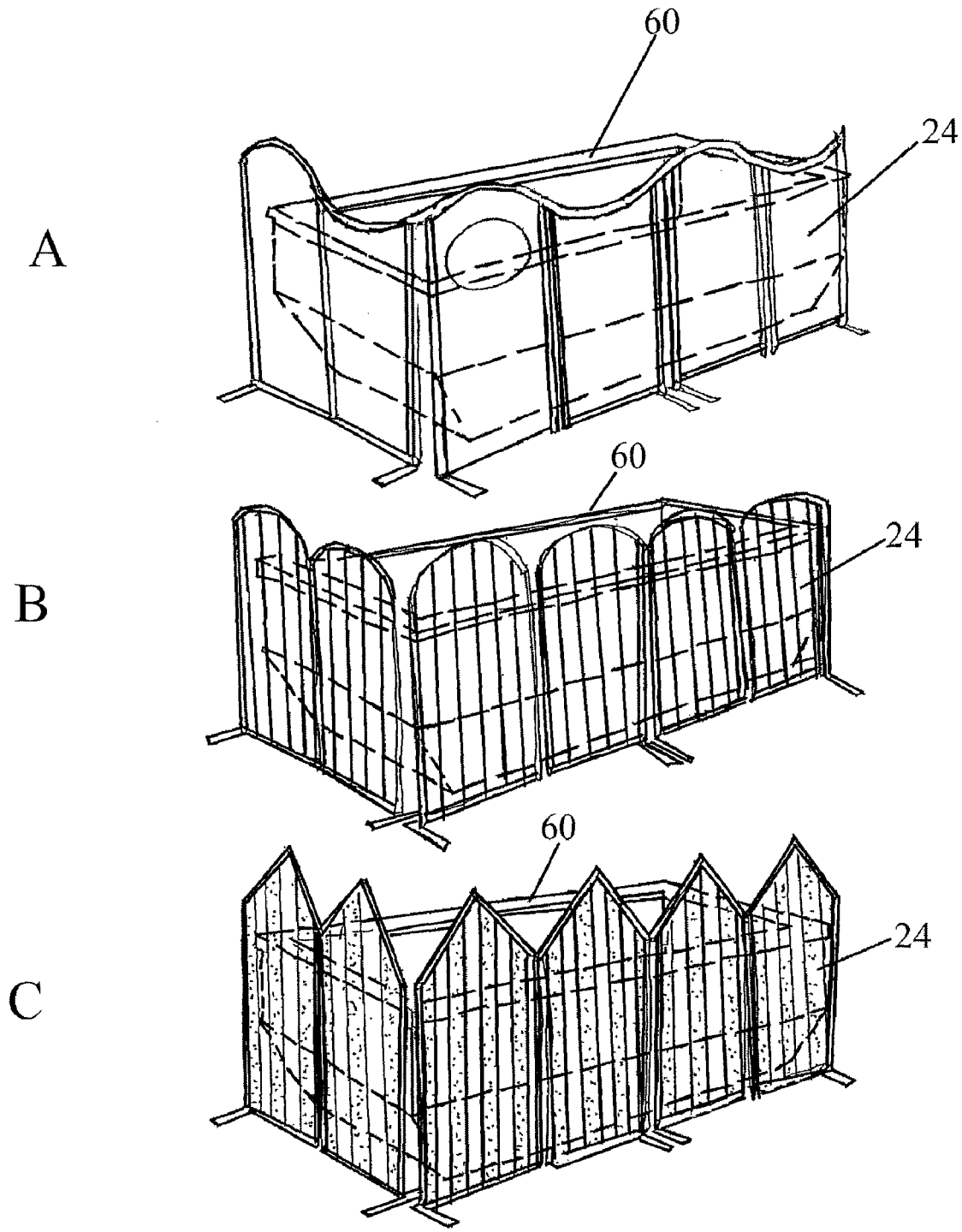
FIGS. 16A, B and C depict various embodiments where panels of different configurations are used to obscure waste bin containers.

In other embodiments of the present invention (see, e.g., FIG. 15), a structure is provided that effectively camouflages and/or hides the outward appearance of a waste container bin 60. As with the cabana-like structure 20 described above, the similar pole structure devices 28 can be employed around the waste bin container 60, either entirely surrounding such container or having designed open areas to facilitate access to the waste bin container 60. As such, in certain embodiments, three out of four sides of a waste bin container 60 are encircled by fabric facades. As with the cabana-like structure 20 described above, it is within the scope of the present invention to have pole members 28 and/or materials supported on the pole members 28 also physically associated with the sides, top or bottom of any waste container bin 60, thus facilitating easy construction and providing solid support for such structures. For example, hook and loop structures (Velcro) can be provided such that an adhesively applied hook and loop structure is attached to the side of a waste bin 60 with a correspondingly attachable Velcro element being provided on the cabana-like tent structure 20, thereby facilitating relatively easy covering of such waste bin structures 60. As one will appreciate, while supporting poles 28 can be used in such embodiment, it is within the scope of the invention to eliminate any use of supporting poles 28 and merely relying upon the Port-O-Let 22 and/or waste bin container 60 itself for the structure necessary to support such fabric.

Figure 12:
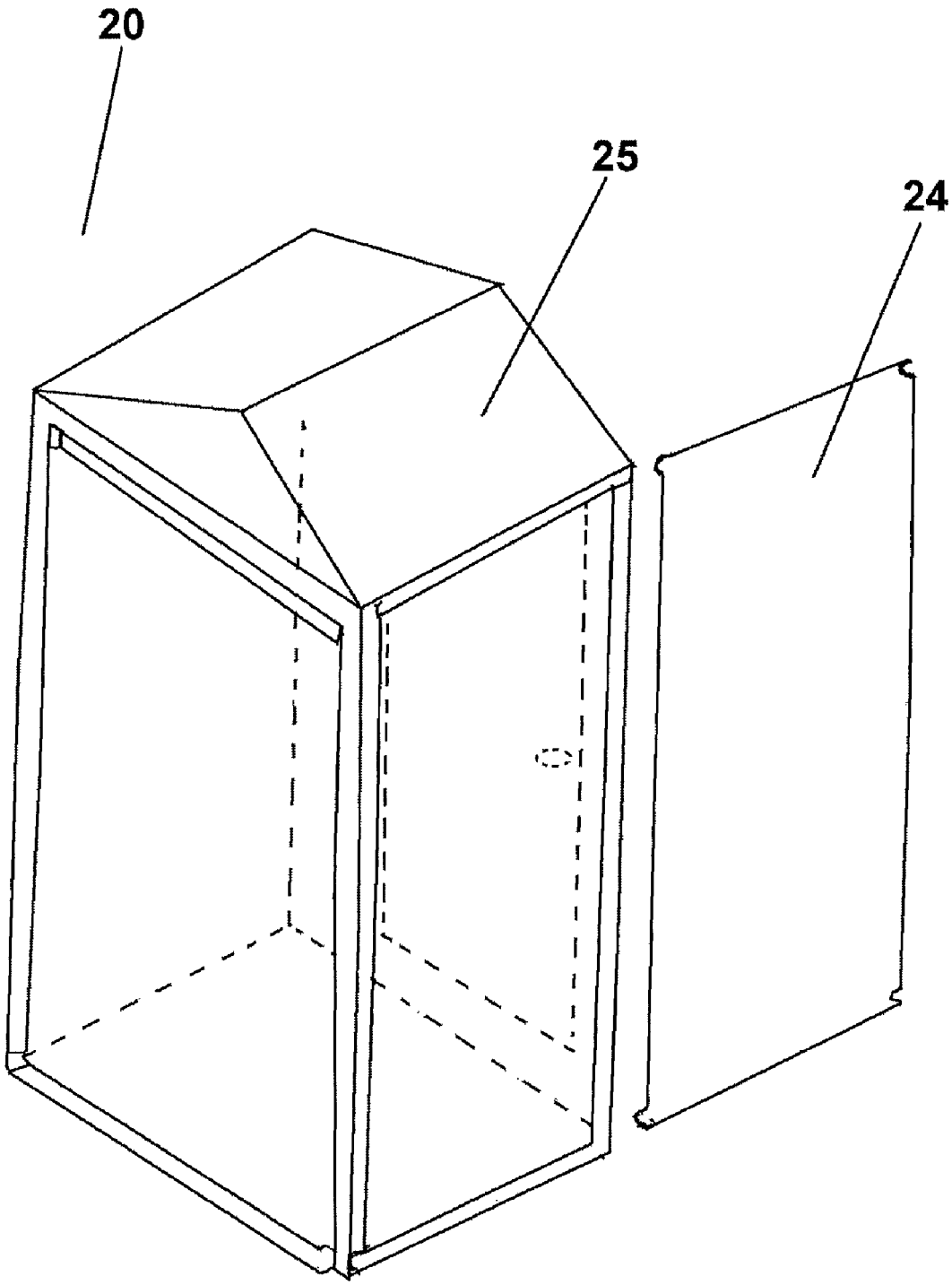
FIG. 12 depicts an embodiment where slidably engagable connection means is employed to secure coverings directly to the structure.
Figure 13:
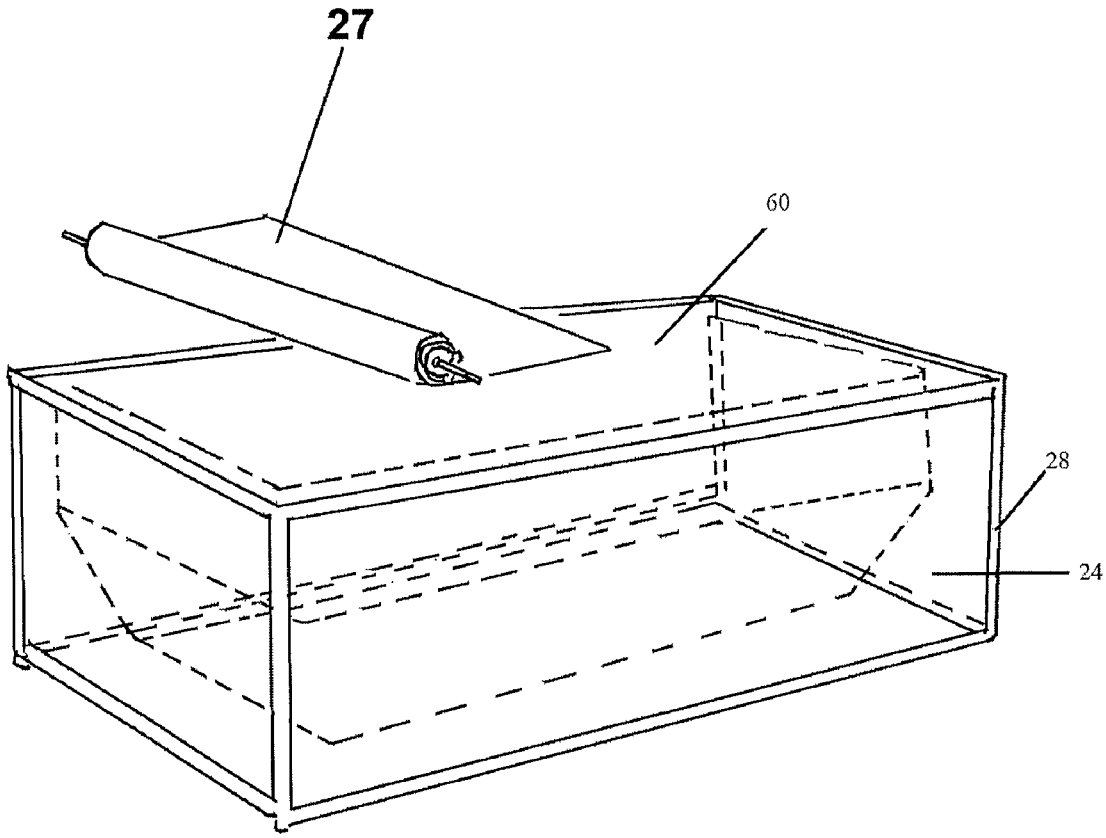
FIG. 13 depicts an embodiment where a waste bin structure is covered on its side and top.
Figure 14:
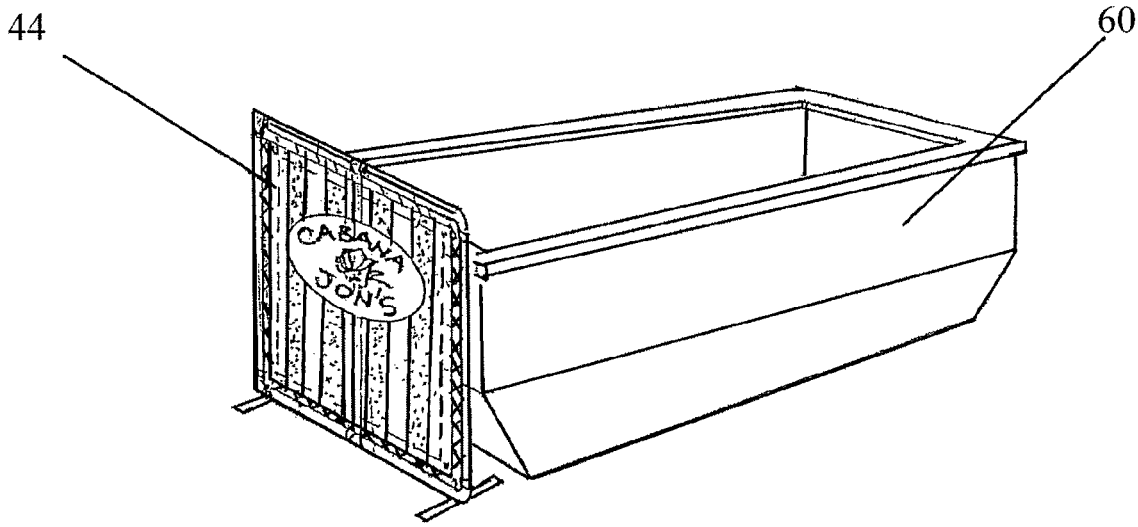
FIG. 14 depicts an embodiment where separate panels are employed to obscure the undesired viewable aspects of a waste bin container, with such panels having advertising associated therewith.

In other embodiments, a roof structure is provided to extend over the waste bin structure 60 top portion. As described above with respect to the cabana-like structures 20 encircling and covering a Port-O-Let 22, similar arched pole members 26 can be provided to create an arched structure whereby fabric can be stretched over the top 25, thus creating a visually appealing top most structure 25 to the waste bin container 60. Alternatively, the A-frame and/or tetrahedral pole structure 26 as described above could also be utilized with a waste bin container 60. In an embodiment where the waste bin container 60 itself provides the support for descending/hanging fabric expanses on the sides of the waste bin container 60, the top most portion of the waste bin container 60 can be provided with suitable snap-on fixtures that accommodate either straight or bent poles (see FIG. 12). Thus, one aspect of the present invention entails provision of a plurality of pole supporting structures 28 that are easily associated with the top most portion of a waste bin container 60.

As described above, various lighting configurations can be provided in order to ensure safety and/or aesthetic compliments to the structures as set forth in the present invention. In one embodiment, for example, a light structure is provided at or near the apex of a roof, with the light shining into the interior of the structure. If color lights and/or fabrics are utilized with this particular embodiment of the invention, a pink light could be provided to denote that the Port-O-Let 22 covered is for females, whereas a blue light could denote that a separate Port-O-Let 22 is for males. Similarly, when particular events are held that have a color associated therewith (e.g., pink for breast cancer charity events) effective lighting of such structures either with illumination provided on the sides 24 and/or top of the structures 25 is an aspect of the present invention.

Figure 6:
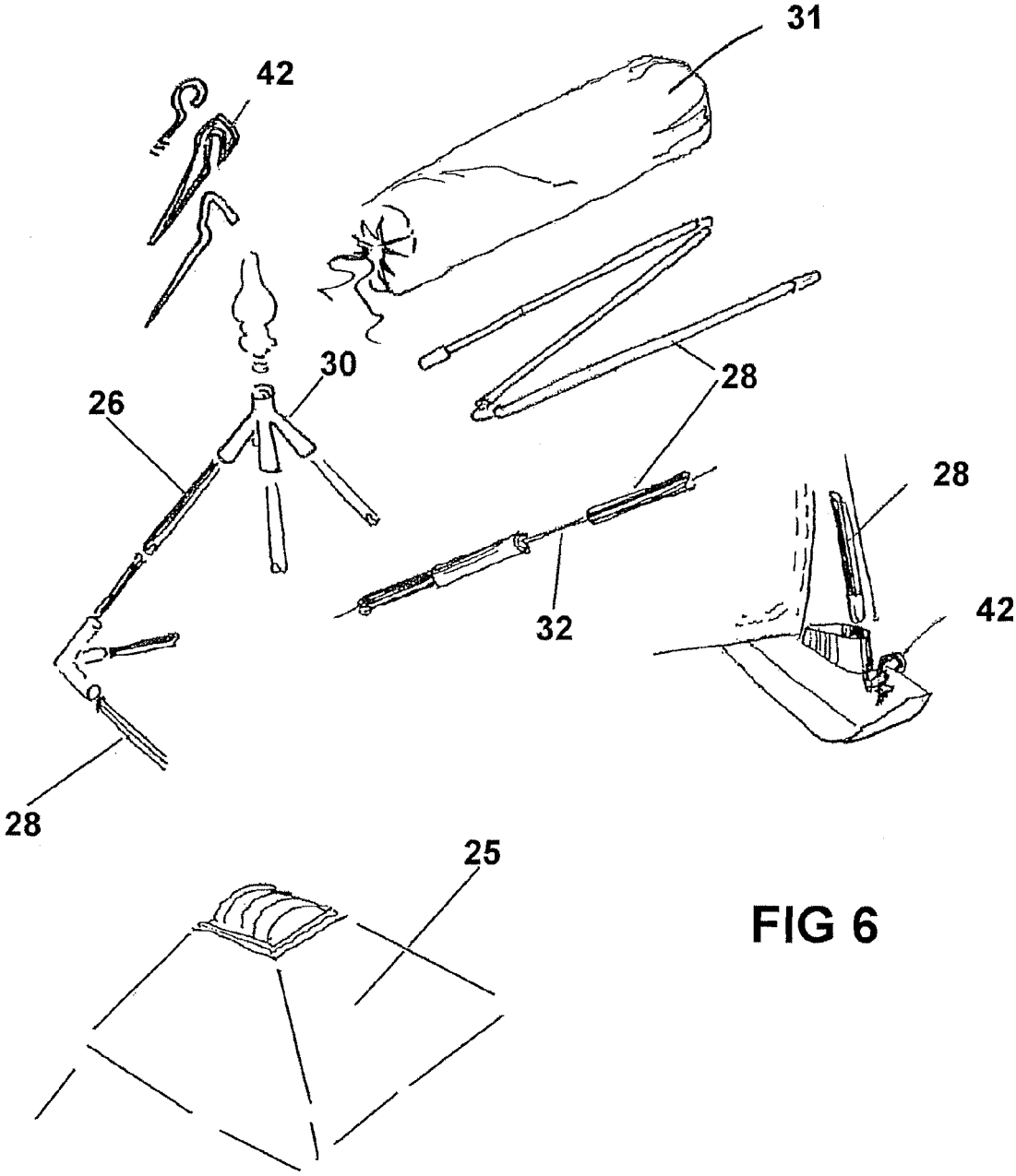
FIG. 6 depicts various possible alternative embodiments where supporting poles can be joined by elastomeric means, folded and transported in a transport bag, where ventilation means is provided on a top-most covering, and where supporting poles can be attached to structures.
Figure 7:
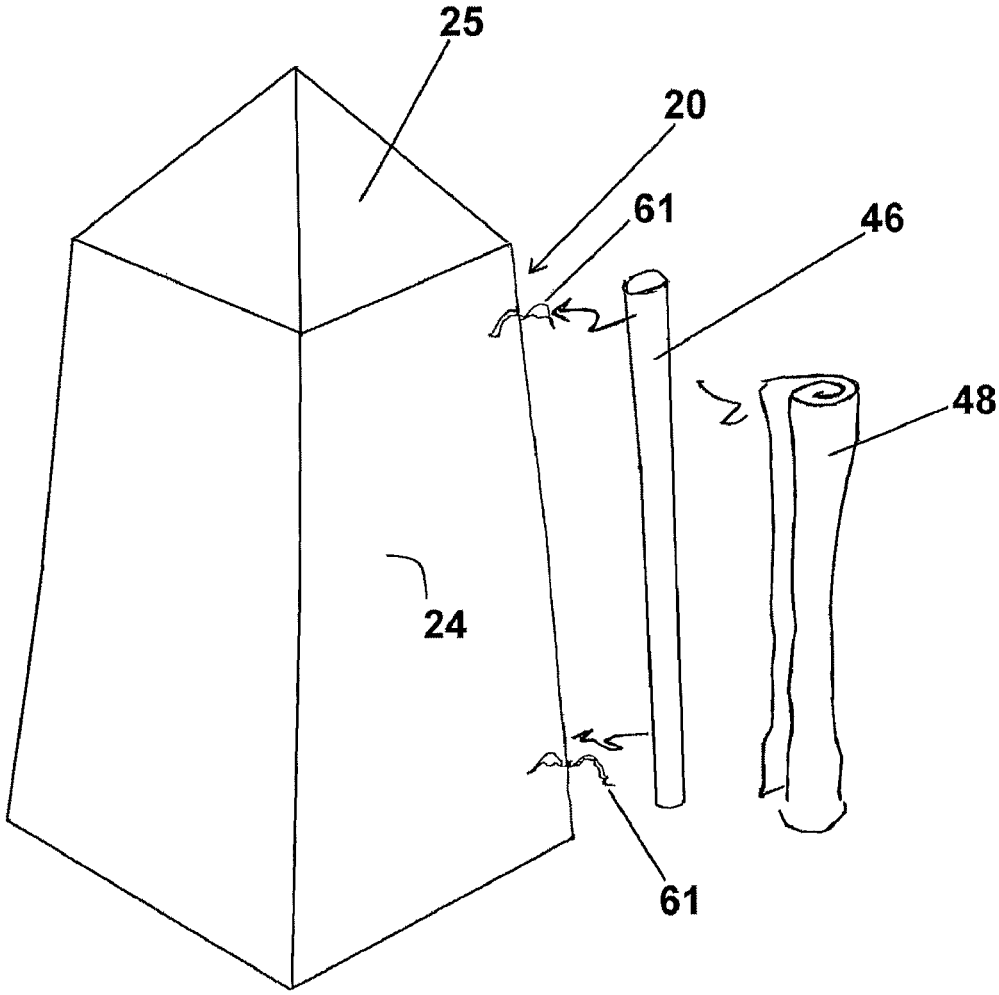
FIG. 7 depicts depicts one embodiment where material is retractably mounted on a rotating gathering device.
Figure 8:
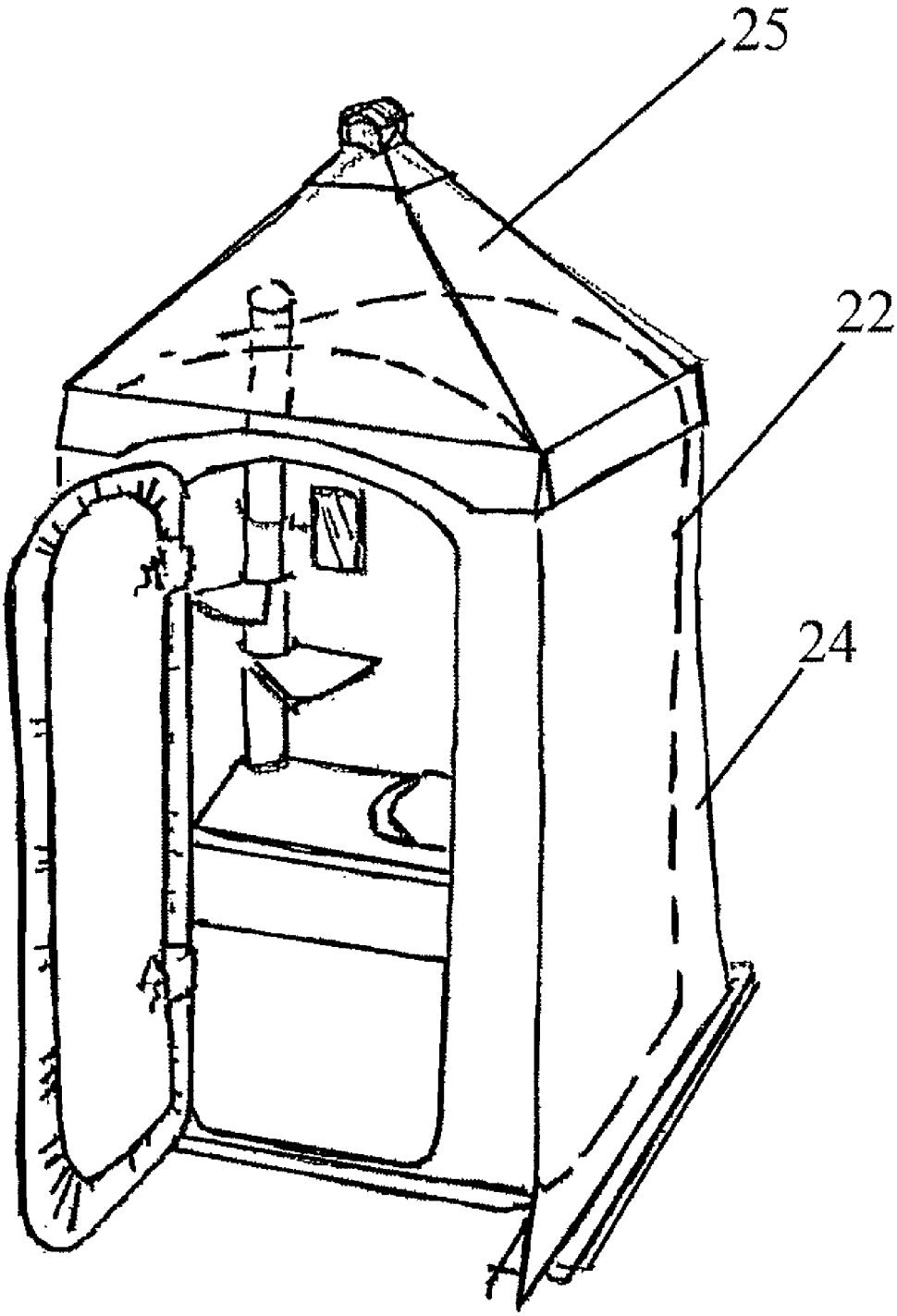
FIG. 8 depicts one embodiment of the invention where covering material is associated directly with a portable toilet structure.

One aspect of the present invention is directed to a portable kit containing the support members and fabric components of the present invention. Such kits could be rented out by various rental companies that also either supply Port-O-Lets 22 for use or that provide tents, tables, chairs, etc. for various entertainment functions. For example, as illustrated in FIG. 6, various hooks, ground supporting and connecting members 42, detachable poles 26, 28 and connectors therefore 30 can be combined in a bag 31. Poles 28 can be in different connected lengths with stretchable nylon or elastomeric cords 32 therebetween to facilitate storage and easy completion of the expanded units.

In still other embodiments of the present invention, supporting poles 28 and cross members are primarily eliminated and the Port-O-Let 22 structure itself is relied upon for structural support to hang or to otherwise support fabric/plastic material covering such Port-O-Let 22 surfaces. For example, hook and loop type structures that are alternatively attached to the Port-O-Let 22 structure and conversely to the aligned fabric of the present invention can be provided on the sides 24 of a Port-O-Let 22. A central tent pole support member 46 can be substantially centrally positioned on the apex of the Port-O-Let 22 so as to suspend a tent-like structure from the top 25 thereof. The sides 24 of such tent-like structure can also be associated with hook and loop structures on respective corners of the Port-O-Let 22 outlet.

Figure 11:
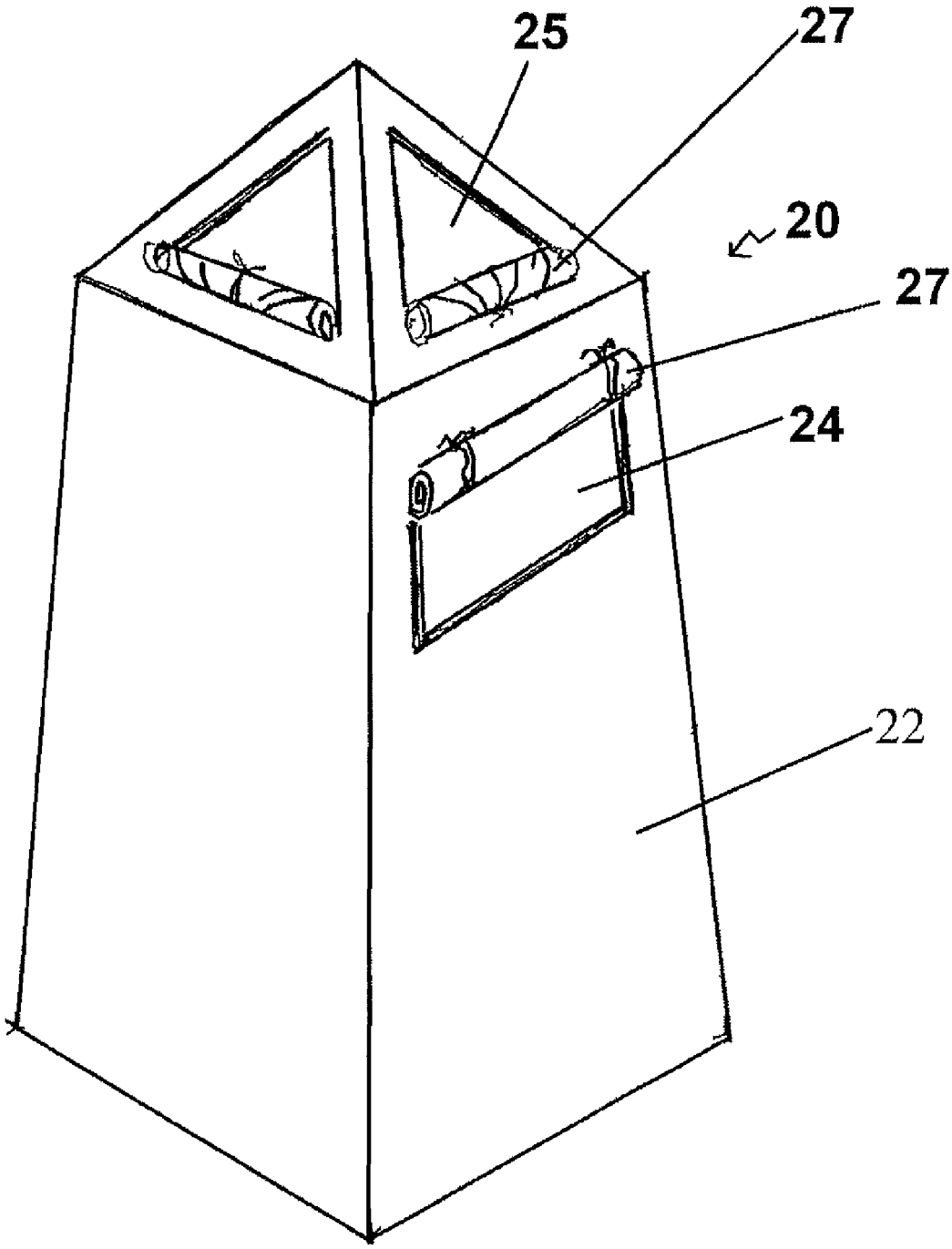
FIG. 11 depicts an embodiment of the invention where roll-up shades re employed to provide desired ventilation, light, etc.

Turning to yet another embodiment of the present invention, a reversibly roll up mechanism can be provided such that the side 24 portions of material covering a Port-O-Let 22 outlet can be reversibly drawn up around such "pull shade-like structure." In one embodiment as pictured in FIG. 11, separate pull shade mechanisms are reversibly mounted to the side 24 of a Port-O-Let 22 outlet. The fourth side 24 is preferably provided with a pull down structure that contains an awning fabric piece that can be deployed and then supported by separate poles 46 extending away from the Port-O-Let 22 structure. In a similar fashion, substantially triangular shaped pieces of fabric can be mounted on a reversibly shape pole structure 46 such that such pull down features can be mounted at a lower point of the Port-O-Let 22, around the beginning of the roof structure, itself, etc. such that when the fabric is pulled out and extended completely from the shade pull structure, it can be attached at the upper most apex region of the structure (see FIG. 11). The objective with such retractable fabric gathering mechanisms is to make it relatively easy to encircle a Port-O-Let structure 22 in a minimal amount of time. Such drawstring structure also facilitates the quick demantling of such structures after use and easy storage in suitably sized container bags. As one will appreciate, several pull shade mechanisms can be provided on or retrofittable to a Port-O-Let structure 22 thus providing for an ability to modify the fabrics used on such structures by merely replacing a pre-wound pull shade. One of ordinary skill in the art will appreciate the various ways that a pull shade structure can be associated with either a Port-O-Let 22 or construction bin 60. Preferably, a mounting bracket 36 is provided for ready attachment to the sides 24 of a Port-O-Let 22 and/or waste container 60 such that a pull down shade structure can be mounted thereto. Ballast means can be provided on any covering material, particularly at the bottom thereof, to provide sufficient weight to insure stability of the covering material when in place, and to otherwise prevent undesired wind disruption of the structure. Such ballast means can include, for example, water inflatable pockets so as to facilitate easy transport of such structures after voiding the water retaining bladders of such ballast structures (not shown). Other ballast means can be employed, for example, other weights can be associated with various portions of a covering material or frame thereof, to accomplish the stability function sought to be achieved.

As one of skill in the art will appreciate, various different ways to attach panels, curtains, expansive materials, fabrics, etc. encompassed by the present invention to cover sides and/or top most regions of portable toilets or waste bin containers, can be achieved by various different structural means. These include, but are not limited to, support devices as disclosed, for example, in U.S. Pat. No. 7,134,470 to McCance, which is incorporated herein in its entirety by this reference. Accordian door-like structures can also be utilized, such as that disclosed in U.S. Pat. No. 6,615,894 to Mckeon, which is incorporated herein in its entirety by this reference. It is contemplated that either horizontally or vertically oriented mating slidable connecting members can be employed to facilitate attaching covering materials to the exterior sides of portable toilets and waste bin containers as described herein. Inventors incorporate herein by reference the description of appropriate securing means, including those described in U.S. Pat. No. 6,182,738 to Chen; U.S. Pat. No. 6,148,895 to Biggers; U.S. Pat. No. 6,006,809 to Williams et al., all of which are incorporated herein by this reference.

Figure 9:
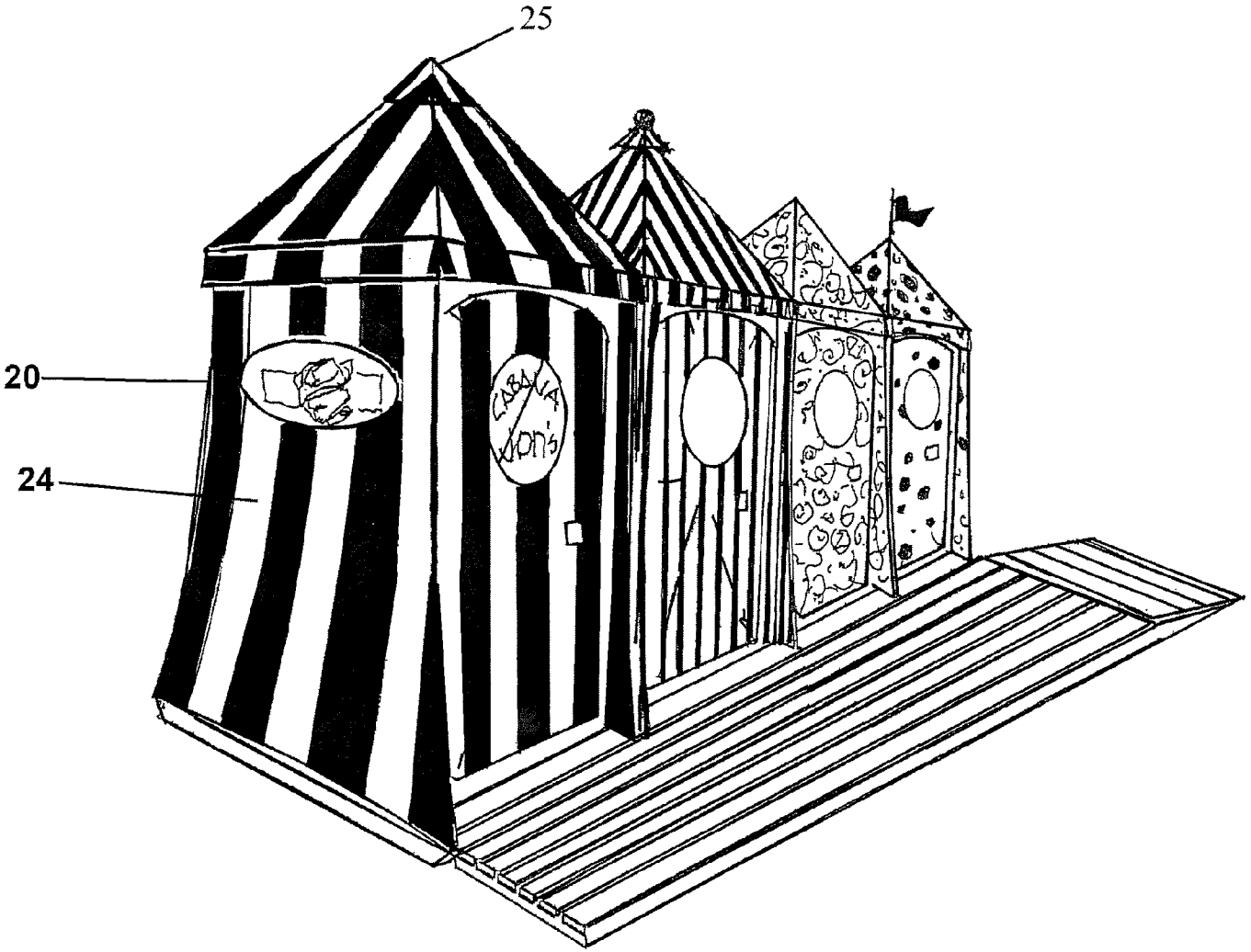
FIG. 9 depicts a series of different coverings where multiple portable toilet structures are employed.
Figure 10:
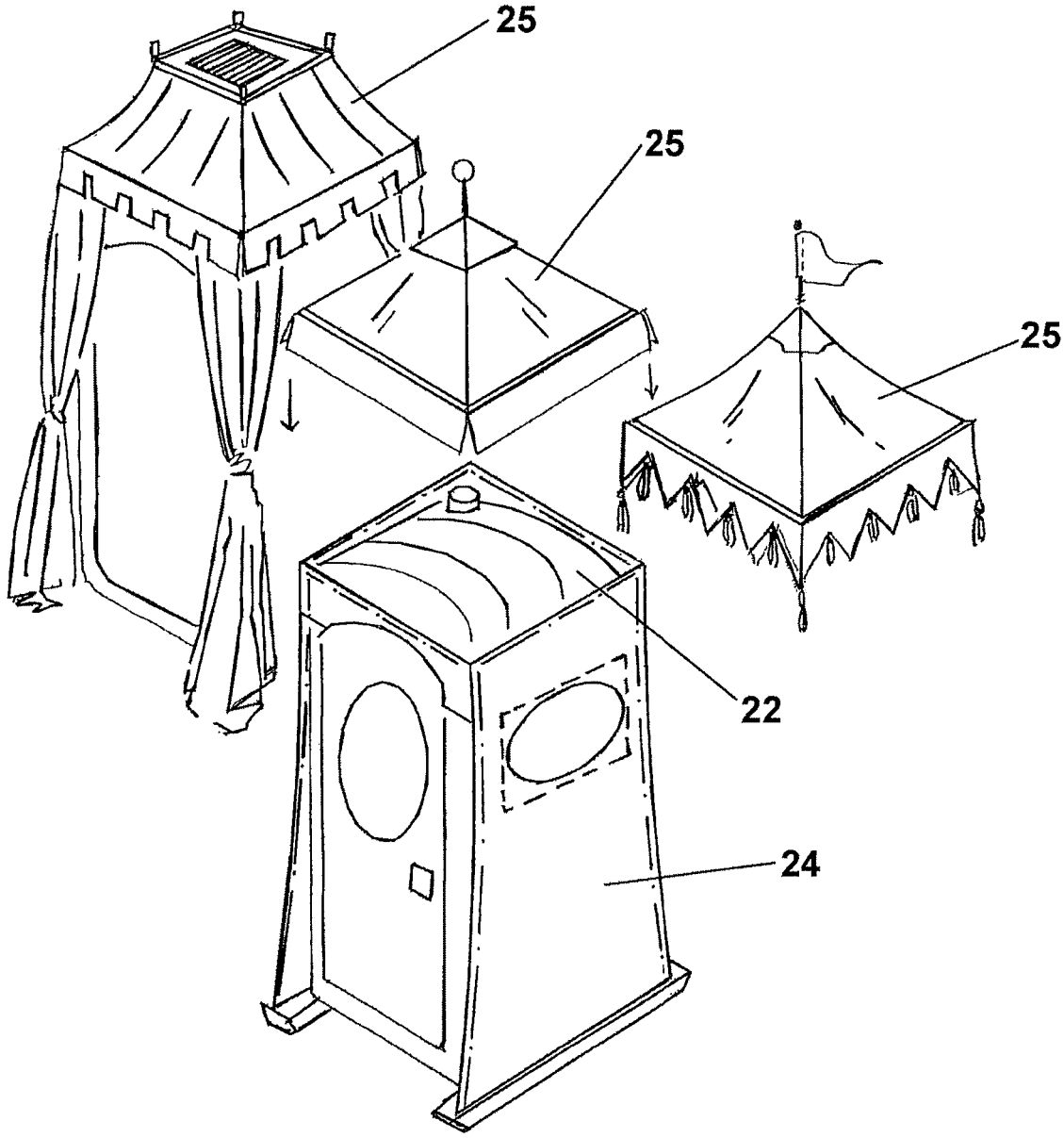
FIG. 10 depicts various alternative styles for top-most coverings for portable toilet structures.

As shown in FIG. 9, another aspect of the present invention relates to a series of cabana-like structures 20 being associated and/or physically connected through their extent and having different possible configurations and ornamentation to distinguish such cabana-like structures.

Incorporated herein in their entirety by this reference are the following: U.S. Patent Publication No. 2006/0123534 entitled "Advertising Method Using a Portable Toilet Unit"; U.S. Pat. No. 6,763,626 to Wieringa, entitled "Portable Toilet Advertising System"; U.S. Pat. No. 6,349,426 to Wieringa, entitled "Portable Outdoor Toilet with Advertising Indicia" and U.S. Pat. No. 5,937,452 to Brewer, entitled "Portable Bathroom Assembly".

For ease of explanation of the figures, the following character number references is provided:

cabana-like structure—20
Port-O-Let structure—22
sides (of cabana)—24
top (of structure)—25
roof support members—26
pull down mechanism—27
supports/poles—28
connecting angle piece—30
elastic cord—32
telescoping members—34
retractable pin—36
awning support poles—40
stakes—42
info/advertisement banner—44
additional pole—46
banner—48
sleeve—50
waste bin—60
bracket—61

Moreover though the description of the invention has included descriptions of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A covering for a portable toilet structure having at least four walls and a ceiling, comprising, a) a free-standing portable toilet structure having four sides and a top-most portion, said sides and top most portion having an exterior comprising a rigid material;

b) an expanse of material sized to cover substantially all of an exterior portion of a portable toilet structure, said expanse of material comprised of a weather resistant material less rigid than material forming the exterior portion of the portable toilet structure, wherein said expanse of material comprises a phase change material, and said material being sized so that when placed in association with said portable toilet structure, at least three sides of said exterior portion of said portable toilet structure are substantially obscured from view;

c) a connection means operatively associated with the portable toilet structure for securing said expanse of material thereto, said connection means comprising connection points selected from the group consisting of slidably engagable members, hook and loop structures, magnetic connection means and bracket assemblies, d) wherein said expanse of material, once secured to said connection means, remains affixed to said portable toilet structure;

e) a top most covering operatively associated with said expanse of material, said top most covering being configured above the portable toilet structure and being comprised of a weather resistant material less rigid than material forming the exterior of the portable toilet structure;

f) wherein said expanse of material comprises a phase change material; and g) A covering for a construction site structure having four walls, comprising, 1) a construction site structure having four sides;

2) an expanse of material sized surrounding an exterior portion of said construction site structure, said expanse of material comprised of a weather resistant material less rigid than material forming an exterior of the structure, said expanse of the weather resistant material being sized so that when placed in association with said structure, at least three sides of said exterior portion of said construction site structure are substantially obscured from view;

3) connection means operatively associated with the construction site structure for securing said expanse of material thereto, said connection means comprising connection points selected from the group consisting of slidably engagable members, hook and loop structures, magnetic connection means and bracket assemblies; and 4) wherein said expanse of material, once secured to said connection means, remains affixed to said construction site structure.

2. The covering as set forth in claim 1, wherein the topmost covering extends beyond the exterior portion of the portable toilet structure.

3. The covering as set forth in claim 1, wherein said expanse of material has at least one appliqué associated therewith.

4. The covering as set forth in claim 1, wherein said expanse of material has attaching means selected from the group consisting of hook and loop connection structures, snaps, buttons, ties, and hooks, said attaching means provided to reversibly attach placards, advertisements or material adapted for adornment of said covering.

5. The covering as set forth in claim 1, wherein said covering is washable by directing a water hose thereto without having to dissociate said covering from said connection means.

6. The covering as set forth in claim 1, wherein said topmost covering is vented to permit wind to pass through apertures.

7. The covering as set forth in claim 1, wherein the covering further comprises a lighting element to illuminate said covering with a desired color of light.

8. The covering as set forth in claim 1, wherein the expanse of material is mounted to a reversibly rotatable element that permits the material to be drawn out in an extended fashion and that can wind said material onto said element to retract said material.

9. The covering as set forth in claim 1, wherein the covering spans at least two side walls of two separate portable toilet structures when placed adjacent to each other.

10. The covering as set forth in claim 1, wherein said covering further comprises an insulating material.

11. The covering as set forth in claim 1, wherein said covering further comprises a reflective material operatively associated therewith so that said structure is more visible under illumination.

12. The covering as set forth in claim 1, further comprising engaging mating connectors comprising tubular perimeter frame poles supported by said portable toilet structure, said frame poles attached to the structure using hook and loop fastener elements oppositely opposed to each other and provided on the covering and one of the portable toilet structure or said frame poles to secure the covering about the structure.

13. The covering as set forth in claim 1, wherein said covering encompasses more than one structure.

14. The covering as set forth in claim 1, wherein said covering material is adapted to envelop perimeter frame poles reversibly connectable to said structure.

15. The covering as set forth in claim 14, wherein said frame poles form a roof apex structure.

16. The covering as set forth in claim 14, wherein said poles comprise telescoping poles.

17. The covering as set forth in claim 14, wherein said poles are of different lengths and have elastomeric cords therebetween.

18. The covering as set forth in claim 1, further comprising a ballast securing mechanism along at least one of the four walls of the structure.

* * * * *